United States Patent [19]

Hirata et al.

[11] 4,337,733

[45] Jul. 6, 1982

[54] COOLING LIQUID TEMPERATURE CONTROL SYSTEM FOR INTERNAL COMBUSTION ENGINE

[75] Inventors: Makizo Hirata, Kakogawa; Shinji Abe, Akashi, both of Japan

[73] Assignee: Kawasaki Jukogyo Kabushiki Kaisha, Kobe, Japan

[21] Appl. No.: 256,746

[22] Filed: Apr. 23, 1981

[30] Foreign Application Priority Data

Apr. 28, 1980 [JP] Japan ..... 55-56946

[51] Int. Cl.[3] ..... F01D 7/16

[52] U.S. Cl. ..... 123/41.1; 123/41.13

[58] Field of Search ..... 123/41.07, 41.08, 41.09, 123/41.1, 41.13; 236/34, 34.5

[56] References Cited

U.S. PATENT DOCUMENTS

| | | | |
|---|---|---|---|
| 1,253,695 | 1/1918 | La Porte | 123/41.13 |
| 1,306,000 | 6/1919 | Fulton et al. | 123/41.1 |
| 2,075,521 | 3/1937 | Hild | 123/41.13 X |
| 2,622,572 | 12/1952 | Nallinger | 123/41.13 X |
| 3,726,262 | 4/1973 | Moon | 123/41.1 |
| 4,144,849 | 3/1979 | Dahm | 123/41.1 X |

*Primary Examiner*—William A. Cuchlinski, Jr.

*Attorney, Agent, or Firm*—Jordan and Hamburg

[57] ABSTRACT

A cooling liquid temperature control system for an internal combustion engine cooled by a cooling liquid which in turn is cooled by a heat exchanger, wherein a primary bypass opened and closed by a low operating temperature thermostat valve and a secondary bypass opened and closed by a control valve are branched from a cooling liquid outlet passage connected between an engine jacket and the heat exchanger. The control valve can be opened depending on the degree of the opening of the throttle valve. The secondary bypass is branched from the cooling liquid outlet passage. The two passages are respectively opened and closed by a high operating temperature thermostat valve. The secondary bypass is communicated with the primary bypass and the other passage communicated with the heat exchanger. During normal engine operation with small throttle opening, the cooling liquid flows from the secondary bypass to the primary bypass through one passage, to be returned to the engine jacket while being kept at high temperature. At large throttle opening range, the cooling liquid flows to the heat exchanger through the other passage while the secondary bypass is closed, and has its temperature reduced before being returned to the engine jacket.

5 Claims, 10 Drawing Figures

COOLING LIQUID TEMPERATURE CONTROL SYSTEM FOR INTERNAL COMBUSTION ENGINE

BACKGROUND OF THE INVENTION

This invention relates to a cooling liquid temperature control system for an internal combustion engine of the liquid cooled type.

A cooling liquid temperature control system of the prior art for a liquid cooled internal combustion engine will be described by referring to FIG. 1 in which a thermostat valve 3 is mounted at an outlet of a jacket 1 containing a cooling liquid 2 for cooling the engine. When the temperature of the engine rises, the cooling liquid 2 absorbs the heat of the engine and its temperature rises, causing the thermostat valve 3 to move to a lower position to open a radiator inlet passage 4 and close a bypass 5. The cooling liquid of elevated temperature flows through the inlet passage 4 into a radiator 6 where the heat is dissipated. After having its temperature reduced, the cooling liquid 2 flows through a radiator outlet passage 7 into a pump 8 which returns the cooling liquid to the jacket 1 through a return passage 9.

When the temperature of the engine is low, the temperature of the cooling liquid 2 in the jacket 1 does not rise and the thermostat valve 3 does not move to the lower position, so that the radiator inlet passage 4 remains closed and the bypass 5 remains open. Thus the cooling liquid 2 is drawn through the bypass 5 into the pump 8 which returns the cooling liquid 2 to the jacket 1 through the return passage 9.

The opening and closing of the radiator inlet passage 4 by vertical moving of the thermostat valve 3 is decided by a variation in the temperature of the cooling liquid 2. When the temperature of the cooling liquid 2 reaches a predetermined temperature level T1 shown in FIG. 2, in which the abscissa represents the cooling liquid temperature and the ordinate indicates the valve lift, the thermostat valve 3 is moved for opening. In FIG. 2 T1 shows the valve opening temperature and T2 shows the valve closing temperature.

(1) When the predetermined temperature T1 is set at a high level, fresh intake is overheated by the heat of the cylinder and crankcase in a liquid cooled internal combustion engine, particularly in a two cycle engine of the crank chamber pre-pressurizing type, and the temperature of the heated fresh intake is mainly determined by the temperature of the cooling liquid 2, as can be seen in the diagram shown in FIG. 3. Thus when the temperature at which the thermostat is set for operation is high, the air-fuel ratio and charging efficiency of the fuel-air mixture become lower and the power developed by the engines is lower than when the temperature at which the thermostat is set for operation is low, because the volume and flowrate of the intake remain constant.

(2) When the temperature T1 is low, the fresh intake is free from overheating by the heat of the cylinder and crankcase. However, the low temperature of the fresh intake adversely affects vaporization of the fuel-air mixture, causing a reduction in combustion efficiency. The result of this is that fuel consumption increases and the response of power to acceleration decreases. This tendency is particularly marked at partial load of low and intermediate speed and idling, and induces irregular combustion in a two cycle engine.

The application of this cooling liquid temperature control system in an automotive vehicle, snowmobile and a motorcycle would suffer the following disadvantages.

(1) When the temperature T1 is high, the charging efficiency and combustion efficiency of the fuel would drop and the ability to accelerate and to travel upgrade would be reduced.

(2) When the temperature T1 is low, the fuel-air mixture would be difficultly vaporized and the combustion efficiency of the fuel would drop.

At the same time, accelerating ability (acceleration response) would be reduced and fuel consumption during both travelling and idling would increase.

SUMMARY OF THE INVENTION

This invention has as its object the provision of a novel cooling liquid temperature control system for a liquid cooled internal combustion engine which obviates the aforesaid disadvantages of the prior art.

The outstanding characteristics of the invention are that a thermostat valve set at a low operating temperature is mounted at the junction of a primary bypass maintaining the outlet of the jacket for a cooling liquid in communication with a pump and a cooling water outlet passage connected to a radiator; a cooling liquid control valve coupled to a power control throttle valve is mounted at the junction of the cooling liquid outlet passage and a secondary bypass connecting the cooling liquid outlet passage to the pump; and a thermostat valve set at a high operating temperature is mounted at the junction of the secondary bypass and a tertiary bypass connecting the secondary bypass to the radiator.

In the present invention, the cooling liquid control valve opens the cooling liquid outlet passage and closes the secondary bypass to pass the cooling liquid to the radiator to cool same, when the throttle valve opening is in a large opening range and the temperature of the cooling liquid is in a range in which the thermostat set at a low operating temperature closes the primary bypass and opens the cooling liquid outlet passage. This is referred to as low temperature level control. When the throttle valve opening is in a small opening range, the cooling liquid control valve closes the cooling liquid outlet passage and opens the secondary bypass, to pass the cooling liquid to the secondary bypass. This is referred to as high temperature level control. In high temperature level control, the tertiary bypass is closed and the secondary bypass is opened so that the cooling liquid is returned to the jacket by the pump when the temperature of the cooling liquid is higher than the operating temperature at which the high operating temperature thermostat is set, and the tertiary bypass is opened and the secondary bypass is closed to pass the cooling liquid to the radiator when the temperature of the cooling liquid is higher than the operating temperature at which the high operating temperature thermostat is set. The invention has the effects of improving the accelerating ability (acceleration response) and upgrade travelling ability of automotive vehicles, snowmobiles and motor cycles and reducing their fuel consumption both in travelling and in idling.

DESCRIPTION OF THE PREFERRED EMBODIMENT

Figure 1:
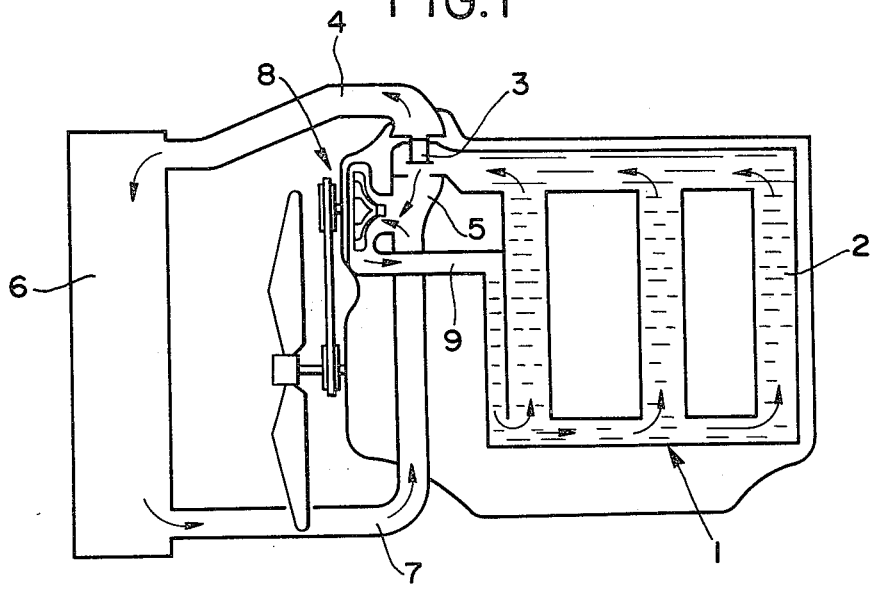
FIG. 1 is a schematic view of a cooling liquid temperature control system of the prior art for a liquid cooled internal combustion engine.
Figure 2:
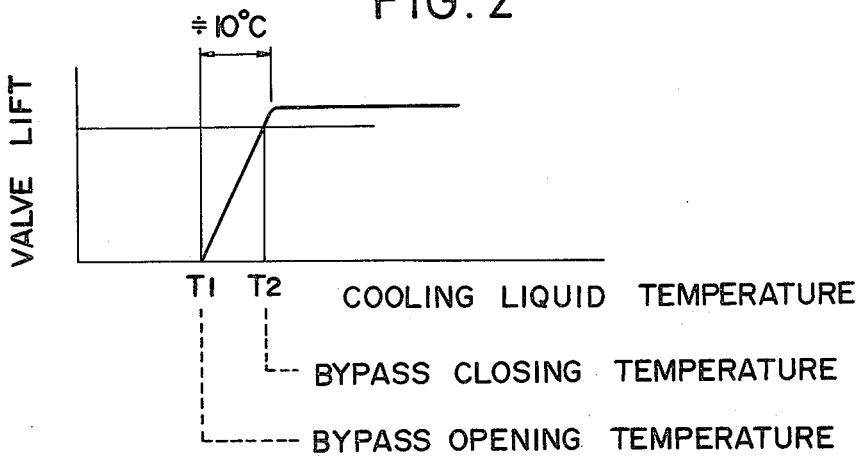
FIG. 2 is a diagram showing the control characteristics of the thermostat valve of the cooling liquid temperature control system shown in FIG. 1.
Figure 3:
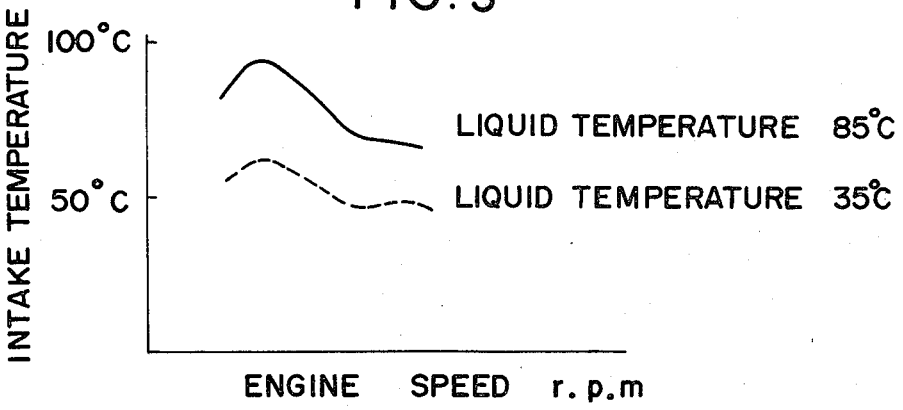
FIG. 3 is a diagram showing the relation between the cooling liquid temperature and the intake temperature.
Figure 4:
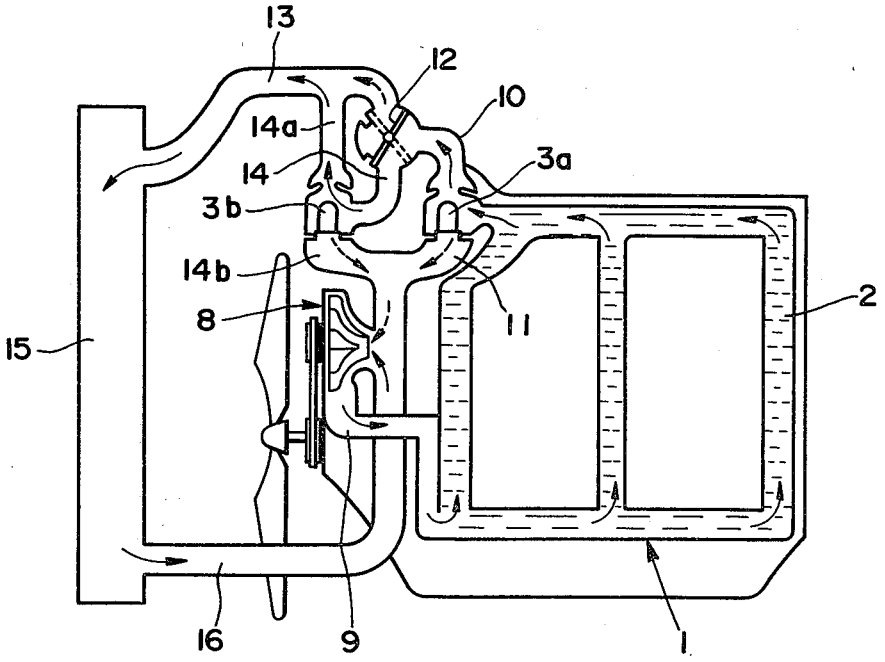
FIG. 4 is a schematic view of the cooling liquid temperature control system according to the invention for a liquid cooled internal combustion engine.

A preferred embodiment of the invention will now be described by referring to the drawings. In FIG. 4, a thermostat valve 3*a* set at a low operating temperature is mounted at the outlet of a jacket 1 containing a cooling liquid 2 for opening and closing a cooling liquid outlet passage 10 and a primary bypass 11 connected to the jacket 1. A secondary bypass 14 branches from the cooling liquid outlet passage 10 midway thereof, and a cooling liquid control valve 12 is mounted at the junction of the cooling liquid outlet passage 10 and secondary bypass 12. The cooling liquid outlet passage 10 is connected to a heat exchanger or a radiator 15 through a heat exchanger inlet passage 13. The heat exchanger inlet passage 13 may be done without and the cooling water outlet passage 10 may be directly connected to the radiator 15. The primary bypass 11 and secondary bypass 14 are connected to a pump 8. A tertiary bypass 14*a* branches from the secondary bypass 14 midway thereof and a thermostat valve 3*b* set at a high operating temperature is mounted at the junction of the secondary bypass 14 and the tertiary bypass 14*a*. In the figure, the numeral 14*b* designates a passage connecting the junction of the secondary bypass 14 and the tertiary bypass 14*a* to the pump 8. The tertiary bypass 14*a* is connected to the radiator 15 through the heat exchanger inlet passage 13. The heat exchanger inlet passage 13 may be done without and the tertiary bypass 14*a* may be directly connected to the radiator 15. The passage 14*b* shown as being directly connected to the pump 8 may be connected to the primary bypass 11 midway thereof. The heat exchanger inlet passage 13 is connected to the inlet of the radiator 15 which is connected at its outlet to an outlet passage 16 which is connected to the inlet of the pump 8 together with the primary bypass 11. The pump 8 is connected at its outlet to the jacket 1 through a return passage 9.

Figure 5:
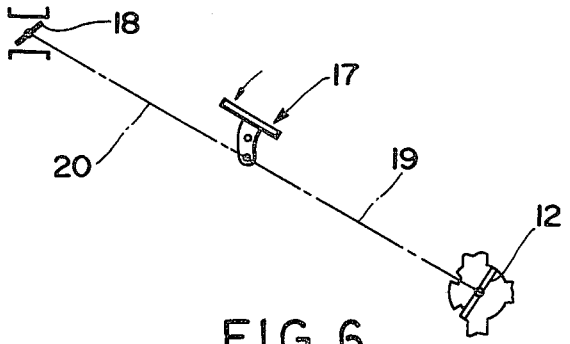
FIG. 5 is a schematic view showing the relation between the operation of the throttle valve of the carburetor and the operation of the cooling liquid control valve taking place in conjunction with each other as the control lever of the engine is actuated.

As shown in FIG. 5, the cooling liquid control valve 12 is connected to a control lever 17 of the engine and a throttle valve 18 of the carburetor with a rod, wire or the like so that the cooling liquid control valve 12 and the throttle valve 18 can be operated in conjunction with each other upon actuation of the control lever 17.

Figure 6:
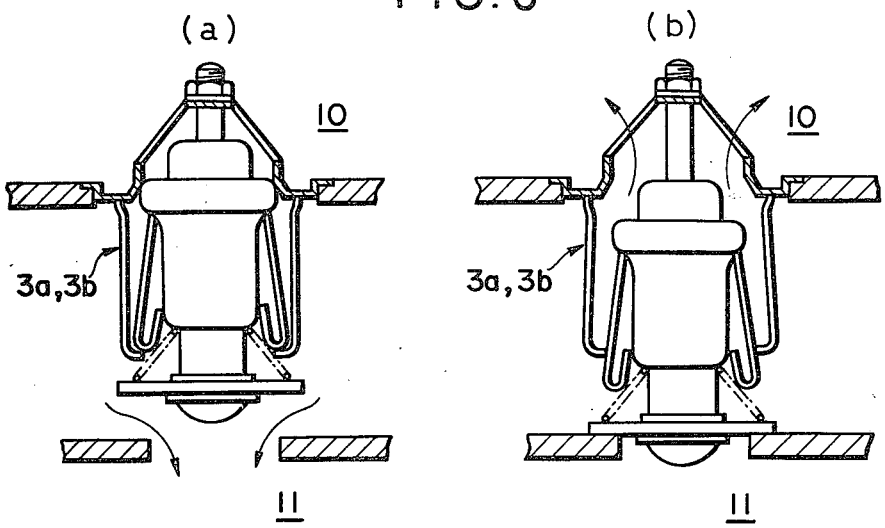
FIG. 6 shows in fragmentary cross section the thermostat valve set at a high (low) operating temperature, FIG. 6*a* showing the valve opening the bypass and FIG. 6*b* showing the valve closing the bypass.

Operation of the cooling liquid temperature control system of the aforesaid construction will now be operated. The cooling liquid 2 in the jacket 1 for cooling the engine shows no appreciable rise in temperature when the temperature of the engine is low. When the temperature of the cooling liquid 2 is lower than the temperature at which the low operating temperature thermostat valve 3*a* is set, the thermostat valve 3*a* remains in its higher position and does not move downwardly, so that the cooling water outlet passage 10 is closed and the bypass passage 11 is opened. This allows the cooling liquid 2 to be drawn by suction into the pump 8 via the primary bypass 11, and the pump 8 returns the cooling liquid 2 to the jacket 1 via the return passage 9. The cooling liquid 2 in the jacket 1 circulated between the jacket 1 and pump 8 as aforesaid absorbs heat and has its temperature gradually raised until it reaches the temperature at which the low operating temperature thermostat valve 3*a* is set. When this temperature level is exceeded, the low operating temperature thermostat valve 3*a* moves downwardly from its upper position to its lower position in which it opens the cooling liquid outlet passage 10 and closes the primary bypass 11 as shown in FIG. 6*b*. This allows the cooling liquid 2 to flow from the jacket 1 to the cooling liquid outlet passage 10. When the throttle valve 18 of the carburetor coupled to the cooling liquid control valve 12 is actuated by the control lever 17 of the engine and has its opening brought to a predetermined large opening range or over ½ opening, for example, the cooling liquid control valve 12 opens the cooling liquid outlet passage 10 and brings same into communication with the heat exchanger inlet passage 13 while closing the secondary bypass 14. Thus the cooling liquid 2 flows into the radiator 15 via the heat exchanger inlet passage 13 and has its temperature reduced by heat exchange. The cooling liquid 2 of lowered temperature is drawn by suction into the pump 8 via the outlet passage 16 and returned by the pump 8 to the jacket 1 via the return passage 9.

When the throttle valve 18 of the carburetor coupled to the cooling liquid control valve 12 is actuated and brought to an opening range which is not in the predetermined large opening range or below ½ opening, for example, the cooling liquid control valve 12 closes the cooling liquid outlet passage 10 and opens the secondary bypass 14, to allow the cooling liquid 2 to flow from the cooling liquid outlet passage 10 to the secondary bypass 14. When the temperature of the cooling liquid 2 is lower than the temperature at which the high operating temperature thermostat valve 3*b* is set (the valve 3*b* of the same construction as the valve 3*a*), the valve 3*b* remains in its upper position as shown in FIG. 6*a* and does not move downwardly, so that the tertiary bypass 14*a* is closed and the secondary bypass 14 is communicated with the passage 14*b*. Thus the cooling liquid 2 flows through the passage 14*b* into the pump 8, either directly or via the primary bypass 11, and the pump 8 returns the cooling liquid 2 to the jacket 1 via the return passage 9. As the temperature of the cooling liquid 2 flowing through the secondary bypass 14 rises above the temperature at which the high operating temperature thermostat valve 3*b* is set, the valve 3*b* moves to its lower position as shown in FIG. 6*b*, so that the tertiary bypass 14*a* is opened and the secondary bypass 14 is closed. This allows the cooling liquid 2 to flow to the radiator 15 via the tertiary bypass 14*a* and heat exchanger inlet passage 13, and has its temperature reduced by heat exchange in the radiator 15. The cooling liquid 2 of reduced temperature flowing through the outlet passage 16 is drawn into the pump 8 which returns the cooling liquid 2 to the jacket 1 via the return passage 9.

Thus the cooling liquid temperature control system according to the invention of the aforesaid construction and operation effects low temperature level control of the cooling liquid when the throttle valve of the carburetor is in a large opening range and effects high temperature level control thereof when the throttle valve is in a small opening range.

Figure 7:
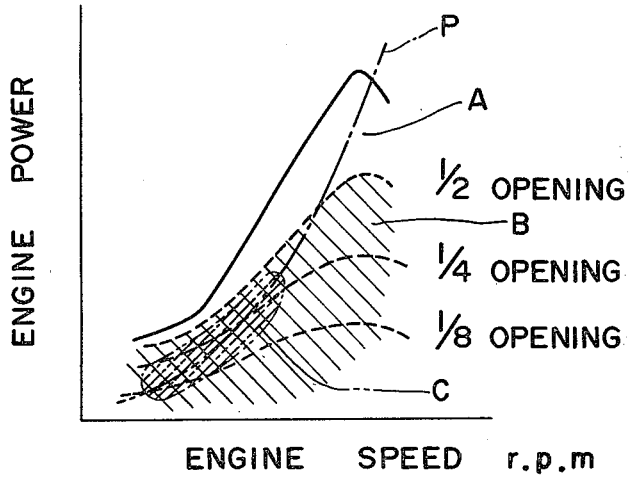
FIG. 7 is a diagrammatic representation of the control of the power of an engine effected by the cooling liquid temperature control system according to the invention.

When the cooling liquid temperature control system according to the invention is incorporated in an automotive vehicle, a snowmobile and a motorcycle, the engines operate as represented by a dash-and-dot line curve P or engine performance curve indicating full throttle opening in FIG. 7 at maximum acceleration and during maximum upgrade travel. Thus by keeping the cooling liquid temperature at a low level in a full throttle opening region A, it is possible to keep the cylinder and crankcase at a low temperature, so that the temperature of fresh intake drops. The result of this is that the air-fuel ratio of the fuel-air mixture and the fuel charging efficiency are improved and the power level of the engine at full throttle opening rises, thereby increasing the accelerating ability and upgrade travelling ability.

By keeping the cooling liquid temperature at a high level in a partial throttle opening region B or ½ opening region in the diagram in FIG. 7, it is possible to raise the temperature of the cylinder and crankcase to suitably heat the fresh intake, thereby promoting vaporization of the fuel-air mixture and improving combustion efficiency. Thus combustion response can be increased and acceleration transition response can be increased in a state of transition from partial throttle opening to full throttle opening and yet fuel consumption can be greatly reduced.

Moreover, at maximum frequency travelling load while travelling on a level load, the engine operates substantially at partial load. Particularly the snowmobile engine with a belt converter operated in a partial load region C of low and intermediate speeds as shown in the diagram in FIG. 7, fuel consumption can be reduced in the partial load region C.

Also, by keeping the cooling liquid temperature at a high level, in the partial throttle opening region B, vaporization of the fuel-air mixture can be promoted during engine idling and incomplete combustion can be avoided, thereby enabling fuel consumption to be reduced.

From the foregoing description, it will be appreciated that the cooling liquid temperature control system for an internal combustion according to the invention is capable of effecting low temperature level control of the cooling liquid when the throttle valve of the carburetor is in a large opening range and effecting high temperature level control thereof when the throttle valve is in a small opening range. When incorporated in an automotive vehicle, a snowmobile and a motorcycle, the control system is conductive to increased accelerating ability (acceleration response) and upgrade travelling ability of the engine and reduced fuel consumption during both travelling and idling of the engine.

Figure 8:
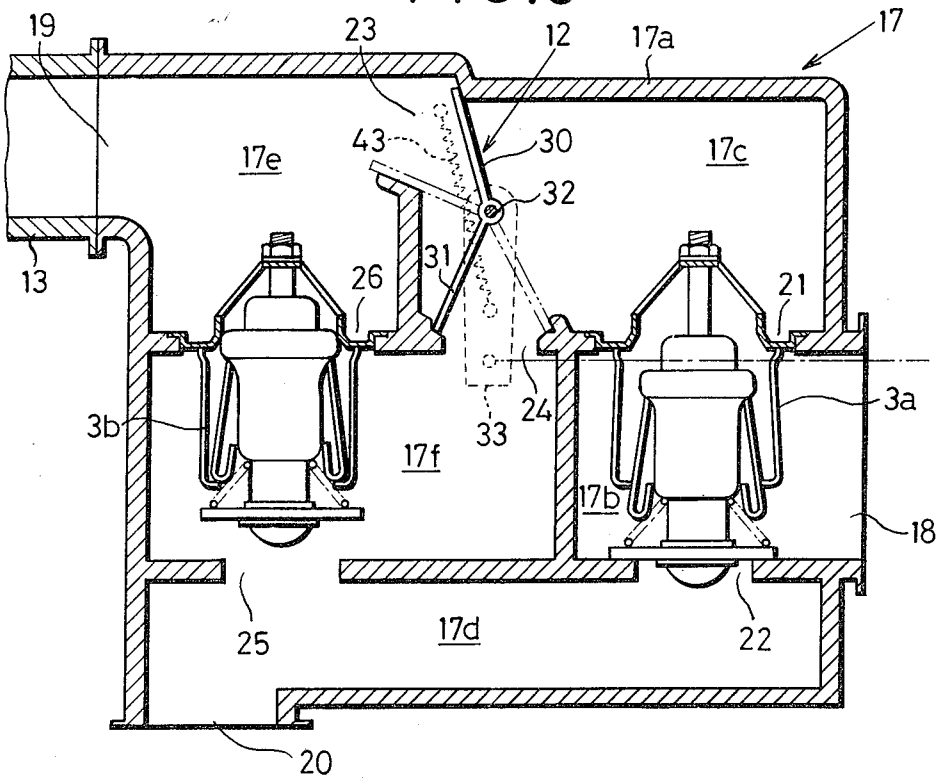
FIG. 8 is a cross section of a valve unit, in which two thermostat valves and the cooling liquid control valve are arranged in accordance with this invention.

FIG. 8 shows a compact and useful valve unit 17 in which the low operating temperature thermostat valve 3*a*, the high operating temperatuure thermostat valve 3*b* and the cooling liquid control valve 12 are arranged according to the present invention.

A housing 17*a* of the valve unit 17 can be detachably connected to the jacket 1. The housing 17*a* has a first opening 18, a second opening 19 and a third opening 20 which are formed in different walls of the housing 17*a* respectively.

The first opening 18 is connected to the outlet of the jacket 1 by a flange joint. The flange joint can be changed with a screw joint or other suitable connecting means.

The second opening is connected to the heat exchanger inlet passage 13 by a flange joint and the third opening 19 is connected to the pump 8 direct or through a conduit by a flange joint. These flange joints can be changed with other suitable connecting means.

In the casing five chambers are formed and each chamber is separated by partitions. The first chamber 17*b* is communicated with the first opening 18. The first chamber 17 is further communicated with the second chamber 17*c* through an opening 21 formed in the partition and with the third chamber 17*d* connected with the third opening 20 through an opening 22 formed in the partition. In the first chamber 17 the low operating temperature thermostat valve 3*a* is arranged for opening and closing the openings 21 and 22. The opening 21 is closed by opening the opening 22 and reversely the opening 21 is opened by closing the opening 22.

The second chamber 17*c* is communicated with the fourth chamber 17*e* and 17*f* by openings 23 and 24 formed in the partitions respectively.

The cooling liquid control valve 12 is arranged in the second chamber 17*c* and opens or closes the openings 23 and 24 alternately.

The fourth chamber 17*f* is communicated with the third chamber 17*d* and the fifth chamber 17*e* connected with the second opening 19 through openings 25 and 26 formed partition respectively.

The high operating temperature thermostat valve 3*b* is arranged in the fourth chamber 17*f* and opens and closes the openings 25 and 26 alternatively in the same manner as the low operating temperature thermostat valve 3*a*. The first chamber 17*b*, the second chamber 17*c* and the fifth chamber 17*e* provide the cooling liquid outlet passage 10. The third chamber 17*d* provides the primary bypass 11. The fourth chamber 17*f* and the opening 25 provide the secondary bypass 14. In FIG. 8 the tertiary bypass 14*a* is provided only by the opening 26.

Figure 9:
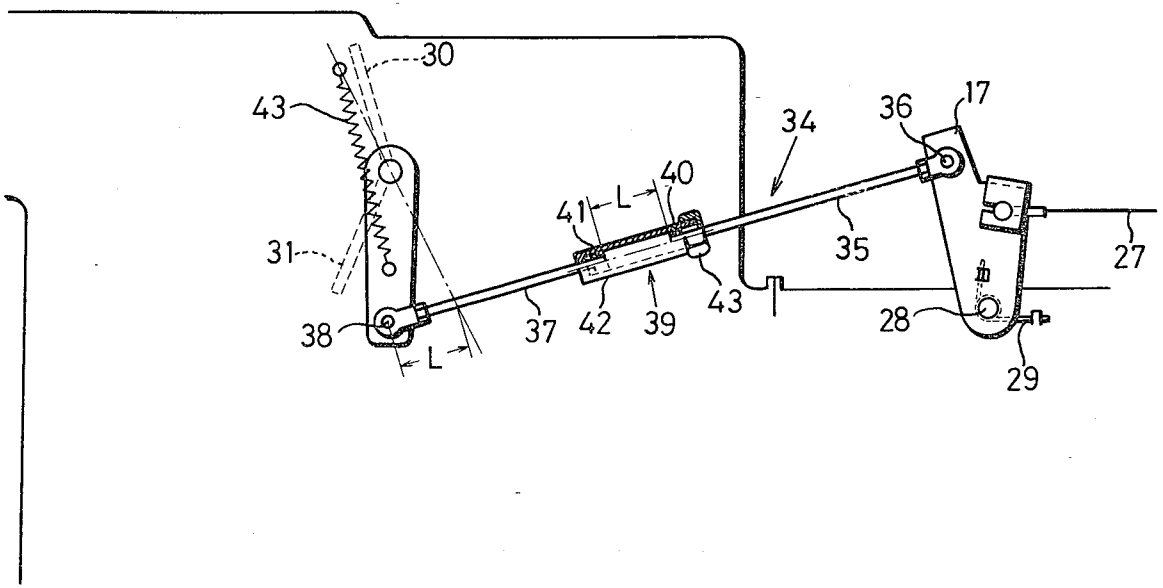
FIG. 9 is a schematic view of an embodiment of a connecting means shown in FIG. 5.

FIG. 9 shows an embodiment of the connecting means in FIG. 5.

The throttle valve 18 is connected with the control lever 17 of the engine by a wire 27 as usual. The control lever 17 is rotatably supported by a pin 28. A return spring 29 is attached to the lever 17 and push the lever anticlockwise in the drawing.

The cooling liquid control valve 12 includes, for example, valve plates 30 and 31 fixed to a shaft 32 as shown in FIGS. 8 and 9. The first valve plate 30 is used for opening and closing the opening 23 and the second valve plate 31 is used for opening and closing the opening 24. Both valve plates can be formed integrally.

The shaft 32 is rotatably supported in the housing 17*a* and fixed to a valve lever 33. The valve lever 33 is connected to the control lever 17 with a control rod 34. The control rod 34 includes a first rod 35 pivotally connected to the control lever 17 through a pin 36 and a second rod 37 pivotally connected to the valve lever 33 through a pin 38.

A free end of the first rod 34 and that of the second rod 37 are inserted into a lost motion connecting means 39. The free end of the first rod 35 is fixed to a first slide piece 40 slidably supported in a cylindrical casing 42 of the lost motion connecting means 39. The free end of the second rod 37 is fixed to a second slide piece 41 slidably supported in the casing 42.

The casing 42 has an opening in one end for inserting the slide pieces therein. The opening of the casing 42 can be closed with a screwed cap 43. The cap 43 can be used as an adjusting means for selecting a maximum distance L between the slide pieces 40 and 41 in a predetermined dimension, for example, in a distance for rotating the control lever 17 corresponding to ½ throttle opening. When the control lever 17 is rotated clockwise in FIG. 9, the throttle valve 18 is opened.

For an initial predetermined angular range of the control lever 17, for example in a range of ½ throttle opening, the slide piece 40 together with the first rod 35 can slide freely relative to the casting 39. After rotating of the control lever over the predetermined range, the slide piece 40 comes to contact with the cap 43 and the slide piece 41 comes to contact with the end of the casing 42 and then the second rod 37 is pulled by the first rod 35. A spring 43 is connected to the valve lever 33 at one end thereof and to the housing 17*a* at another end thereof. As the spring 43 is so arranged that the shaft 32 of the cooling liquid control valve 12 lies near the intermediate position between the both ends of the spring 43, the valve lever 33 is rotated enforcedly by the spring 43, when the center line of the spring 43 pass over a switching line passing through the center of the shaft 32 and the connecting point of the spring 43 with the housing 17*a*. By the enforced rotation of the valve lever 33 the first valve plate opens the opening 23 and the second valve plate closes the opening 24. By the enforced rotation of the valve lever 33 the slide piece 40 and/or the slide piece 41 is shifted relative to the casing 42, so that the control lever can open the throttle valve more over without rotating the valve lever 33.

When the actuating force on the control lever 17 is removed the control lever 17 is rotated anticlockwise by the action of the spring 29.

At first the first rod 35 can be moved freely relative to the casing 42, so that the valve lever 33 is not moved. When the throttle valve is closed to ½ throttle opening, the slide piece 40 comes to contact with the slide piece 41 and push the second rod 37. When the center line of the spring 43 passes over the switching line passing through the center of the shaft 32 and the connecting point of the spring 43 with the housing 17*a*, the valve lever 33 is rotated enforcedly and rapidly. At this time the second valve plate 31 opens the opening 24 and the first valve plate 30 closes the opening 23. By enforced rotation of the valve lever 33, the slide piece 41 apart from the slide piece 40 and then the control lever 17 can close the throttle valve 12 without moving the valve lever 33. It is desirable that the length of the rods 35 and/or 37 so selected, that a rotating angular of the valve lever from an initial position to the switching line can be selected enough to shift the second rod 37 in a predetermined distance L. In this case both the sliding pieces 40 and 41 are settled in a position at which they are in contact with the ends of the casing 42 respectively.

What is claimed is:

1. A cooling liquid temperature control system for an internal combustion engine comprising:

a cooling liquid outlet passage connected at one end thereof to an outlet of a jacket containing a cooling liquid for the engine and at the other end thereof to an inlet of a heat exchanger;

a primary bypass branching from said cooling liquid outlet passage at the outlet of the jacket and connected to an inlet of a cooling liquid circulating pump;

a thermostat valve set at a low operating temperature mounted at the junction of the cooling liquid outlet passage and the primary bypass;

a secondary bypass branching from the cooling liquid outlet passage midway thereof and connected to the inlet of the cooling liquid circulating pump;

a cooling liquid control valve mounted in the junction of the cooling liquid outlet passage and the secondary bypass;

a tertiary bypass branching from the secondary bypass midway thereof and connected to the inlet of the heat exchanger;

a thermostat valve set at a high operating temperature mounted at the junction of the secondary bypass and the thertiary bypass;

an outlet passage connecting the outlet of the heat exchanger the inlet of the cooling liquid circulating pump; and a return passage connecting an outlet of the cooling liquid circulating pump and an inlet of the jacket;

wherein the cooling liquid control valve is coupled to a throttle valve for controlling the power of the engine and operative to open the cooling liquid outlet passage and closes the secondary bypass when the throttle valve has a opening in a predetermined range and to open the secondary bypass and close the cooling liquid outlet passage when the throttle valve has an opening not in the predetermined range.

2. A control system as claimed in claim 1, wherein said secondary bypass is directly connected to the inlet of the cooling liquid circulating pump, said tertiary bypass is directly connected to the inlet of the heat exchanger, and said outlet passage directly connects the outlet of the heat exchanger to the inlet of the cooling liquid circulating pump.

3. A control system as claimed in claim 1, wherein said secondary bypass is indirectly connected to the inlet of the cooling liquid circulating pump, said tertiary bypass is indirectly connected to the inlet of the heat exchanger, and said outlet passage indirectly connects the outlet of the heat exchanger to the inlet of the cooling liquid circulating pump.

4. A control system as claimed in any one of claims 1-3, wherein said heat exchanger is a radiator.

5. A control system as claimed in claim 1, wherein a valve unit having a housing detachably connected to the jacket is provided, in said housing five chambers separated to each other by partitions are formed, a first chamber communicated with the outlet of the jacket is communicated with a second chamber and a third chamber communicated with the inlet of the pump through openings in the partitions, the second chamber is further communicated with a fourth chamber and with a fifth chamber through openings in the partitions, the fourth chamber is further communicated with the fifth chamber connected to the inlet of the heat exchanger and with the third chamber through openings in the partitions, in the first chamber the thermostat valve set at the low operating temperature is arranged, in the second chamber the cooling liquid control valve is arranged and in the fourth chamber the thermostat valve set at the high operating temperature is arranged, the first chamber, the second chamber and the fifth chamber provides the liquid outlet passage, the third chamber provides the primary bypass, the fourth chamber provides the secondary bypass and the opening between the fourth chamber and the fifth chamber provides the tertiary bypass.

* * * * *